US006976294B2

(12) United States Patent
Biondo et al.

(10) Patent No.: US 6,976,294 B2
(45) **Date of Patent: *Dec. 20, 2005**

(54) CASKET HAVING MEMORABILIA COMPARTMENT

(75) Inventors: John P. Biondo, Batesville, IN (US); Dennis C. Laphan, Cincinnati, OH (US); Donald R. Maier, Cincinnati, OH (US); William F. Neth, Batesville, IN (US); Charles F. Winburn, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/189,060

(22) Filed: Jul. 3, 2002

(65) Prior Publication Data

US 2003/0024090 A1 Feb. 6, 2003

Related U.S. Application Data

(63) Continuation of application No. 09/028,796, filed on Feb. 25, 1998, now Pat. No. 6,836,936, which is a continuation of application No. 08/669,022, filed on Jul. 9, 1996, now Pat. No. 5,727,291, which is a continuation-in-part of application No. 08/438,441, filed on May 10, 1995, now Pat. No. 5,611,124.

(51) Int. Cl.[7] ..... A61G 17/00
(52) U.S. Cl. ..... 27/2; 27/14
(58) Field of Search ..... 27/19, 2–14

(56) References Cited

U.S. PATENT DOCUMENTS

| | | | |
|---|---|---|---|
| 331,982 | A | 12/1885 | Lovett |
| 443,209 | A | 12/1890 | Ripsom |
| 504,009 | A | 8/1893 | Whitney |
| 545,176 | A | 8/1895 | Ruebekam |
| 565,282 | A | 8/1896 | Kolle |

(Continued)

FOREIGN PATENT DOCUMENTS

| | | | |
|---|---|---|---|
| GB | 2263388 | | 7/1993 |
| JP | 408112321 | A * | 5/1996 |

OTHER PUBLICATIONS

Batesville Casket Company, News Release, Mar. 15, 1995, 2 pages.
Batesville Casket Company, Memorial Record System brochure, © 1995, 1 page (front & back).
Batesville Casket Company, brochure, © 1991, 4 pages (front & back).
Batesville Casket Company, Memories of You/Memories for Eternity, ©1994, 1 page (front & back).
Batesville Casket Company, Memorial Record, © 1993, 1 page (front only).
Batesville Casket Company, color reproduction of casket lithograph, updated, 1 page (front only).

*Primary Examiner*—William L. Miller
(74) *Attorney, Agent, or Firm*—Wood, Herron & Evans, LLP

(57) ABSTRACT

A casket is provided with an integral memorabilia compartment for the placement, display and storage therein of personal effects and mementos of memorialization of the deceased. In one form the casket comprises a shell, a cap pivoted to the shell, and an openable and closable memorabilia compartment forming a part of the cap. In another form the casket comprises a shell, a cap pivoted to the shell, and an openable and closable memorabilia compartment forming a part of the shell. In both forms the memorabilia compartment is so positioned and configured as to provide convenient access to mourners paying respects to the deceased for placing personal effects and mementos therein and to provide display of the personal effects and mementos placed therein for viewing by the mourners.

12 Claims, 7 Drawing Sheets

U.S. PATENT DOCUMENTS 983,963 A 2/1911 Wetmore
1,027,453 A 5/1912 Wible
D87,176 S 6/1932 Treiber
2,075,859 A 4/1937 Martin
2,676,383 A 4/1954 Lipman
3,435,494 A 4/1969 Bernard
4,252,387 A 2/1981 Wagner
4,324,026 A 4/1982 Craft
4,457,054 A 7/1984 Craft et al.
D278,397 S * 4/1985 Frankenreiter ..... D6/440
D278,609 S 4/1985 Satterelli
4,697,316 A 10/1987 Semon
4,744,376 A * 5/1988 Verducci ..... 132/297
4,788,757 A 12/1988 Bethune et al.
5,088,167 A 2/1992 Rahe
5,090,785 A 2/1992 Stamp
5,215,365 A 6/1993 Godin
5,238,301 A 8/1993 Brady
5,253,838 A 10/1993 Spykerman
5,330,146 A 7/1994 Spykerman
5,379,499 A 1/1995 Jackson
5,426,573 A 6/1995 Jenkins
5,458,272 A * 10/1995 Ward-Weber ..... 229/122.1
5,611,124 A 3/1997 Biondo et al.
5,678,289 A 10/1997 Saaf
5,727,291 A 3/1998 Biondo et al.
6,324,737 B1 12/2001 Chamness et al.

* cited by examiner

CASKET HAVING MEMORABILIA COMPARTMENT

RELATED APPLICATIONS

This application is a continuation of application Ser. No. 09/028,796, filed Feb. 25, 1998, now U.S. Pat. No. 6,836,936, which is a continuation of application Ser. No. 08/669,022, filed Jul. 9, 1996, now U.S. Pat. No. 5,727,291, which is a continuation-in-part of application Serial No. 08/438,441 filed Mar. 10, 1995 now U.S. Pat. No. 5,611,124 and assigned to the assignee of the present invention, the entire substance of which is hereby incorporated by reference herein as if fully set forth in its entirety.

FIELD OF THE INVENTION

This invention relates generally to burial caskets, and more particularly to a casket with a memorabilia compartment forming a part thereof.

BACKGROUND OF THE INVENTION

Currently caskets, whether fabricated from wood or metal, do not provide any designated, easily accessible, receptacle or compartment for either the placement of personal effects of the deceased therein or the inclusion therein of mementos of memorialization by the deceased's family and friends.

Prior attempts at solving this shortcoming have generally taken the form of the placement of a small memento box into the casket alongside the deceased. However, such memento boxes often appear as an afterthought, simply placed alongside the deceased in the casket somewhat haphazardly. Thus, no designated receptacle or compartment which is an integral part of the casket has been provided which could be utilized by the family to commemorate the passing of the deceased.

It is therefore the main objective of the present invention to provide a casket having a memorabilia compartment which is a designated compartment or receptacle specifically for mementos which is an integral part of the casket and which does not present the haphazard appearance of prior memento boxes simply placed alongside the deceased in the casket.

SUMMARY OF THE INVENTION

The present invention attains the stated objective by providing a casket with an integral memorabilia compartment for the placement, display and storage therein of personal effects and mementos of memorialization of the deceased. In one form the casket comprises a shell, a cap pivoted to the shell, and an openable and closable memorabilia compartment forming a part or the cap. In another form the casket comprises a shell, a cap pivoted to the shell, and an openable and closable memorabilia compartment forming a part of the shell. In both forms the memorabilia compartment is so positioned and configured as to provide convenient access to mourners paying respects to the deceased for placing personal effects and mementos therein and to provide display of the personal effects and mementos placed therein for viewing by the mourners.

The cap memorabilia compartment may take the form of any of at least six preferred embodiments.

In one embodiment the casket cap includes a rim and a crown pivoted to the rim, and a memorabilia tray disposed within the cap and accessible upon pivoting the crown away from the rim. In a second embodiment, the casket cap includes a rim and a crown slidably mounted to the rim, and a memorabilia tray disposed within the cap and accessible upon sliding the crown relative to the rim. In a third embodiment, the casket cap includes a rim and a crown attached to the rim, and a memorabilia drawer disposed within the cap and accessible upon pivoting the cap away from the shell and pivoting the drawer away from the rim.

The tray of the first two of these three memorabilia compartments preferably includes a head end compartment, a foot end compartment and a compartment intermediate the head end and foot end compartments. The head and foot end compartments are about one inch deep and the intermediate compartment is about 4 inches deep. The drawer of the second of these two memorabilia compartments preferably includes a front wall, a back wall and a pair of generally triangular shaped end walls connecting the front and back walls. In a casket which includes a single cap the tray is preferably located in the foot end of the single cap, whereas the pivoting drawer is preferably located in the head end of the single cap. In a casket which includes separate head end and foot end caps the tray is preferably located in the foot end cap, whereas the pivoting drawer is preferably located in the head end cap. The casket may be fabricated of either wood or metal.

In a fourth embodiment, the casket cap includes a rim, a header panel attached to one end of the rim and a crown attached to the rim; a memorabilia drawer is disposed within the cap and is slidably accessible through the header panel. In a fifth embodiment, the casket cap includes a rim, a header panel or a portion of the header panel pivoted to one end of the rim and a crown attached to the rim; a memorabilia drawer is disposed within the cap and is slidably accessible upon pivoting the header panel or a portion of the header panel away from the rim.

The drawer of each of these two memorabilia compartments preferably is divided into two compartments. In a casket which includes separate head end and foot end caps the drawer is preferably located in the foot end cap. The casket may be fabricated of either wood or metal.

In a sixth embodiment, the casket cap includes a rim, a crown attached to the rim and puffing peripherally mounted within the interior of the cap to the rim. A memorabilia capsule is disposed in the puffing. At least a portion of the capsule is transparent to allow viewing of memorabilia placed therein. The transparent portion of the capsule is hinged to the balance of the capsule to form a pivoting access door providing access to the interior of the capsule. The puffing is generally quarter-circular in cross section and the capsule is of the same general quarter-circular cross section. In a casket which includes a single cap the capsule is preferably located in the head end of the single cap. In a casket which includes separate head end and foot end caps the capsule is preferably located in the head end cap. The casket may be fabricated of either wood or metal.

The shell memorabilia compartment may take the form of any of at least four preferred embodiments.

In one embodiment the casket shell includes a pair of side walls and a pair of end walls and a memorabilia tray supported by the shell walls and accessible upon pivoting the cap away from the shell. As in the prior embodiments, the tray of this form of the invention includes head end, foot end and intermediate compartments, the head and foot end compartments being about one inch deep and the intermediate compartment being about four inches deep. In a casket including a single cap pivoted to the shell the tray is preferably located in the foot end of the shell. In a casket including separate head end and foot end caps the tray is preferably located in the foot end of the shell. The casket may be fabricated of either wood or metal.

In a second embodiment, the shell includes a pair of side walls and a pair of end walls and a memorabilia drawer disposed within one of the end walls and accessible upon pivoting the drawer away from the one end wall.

In a third embodiment, the shell includes a pair of side walls and a pair of end walls with one of the end walls including a sliding panel portion slidable relative to the balance of the one end wall and providing access to the interior of the one end wall.

In a fourth embodiment, the shell includes a pair of side walls and a pair of end walls and decorative trim movably mounted to a portion of the shell walls and normally concealing a compartment therebehind; the decorative trim is movable from a first position in which the compartment is concealed to a second position in which the compartment is exposed. The decorative trim utilizable for this embodiment may be the basemold, an ear or a corner post. The decorative trim may be pivotally mounted to the portion of the shell walls or may be removably mounted to the portion of the shell walls.

According to a further aspect of the invention, a casket having a memorabilia compartment comprises a shell and a cap closable upon the shell. The cap includes a crown and a header panel at one end of the crown. A memorabilia drawer is within the cap. The drawer is slidably mounted within a frame mounted to the under side of the crown. The drawer is movable to and between a display position and a storage position.

The frame is preferrably rectangular and comprises a pair of side walls and a pair of end walls. The drawer comprises a pair of side walls, a pair of end walls and a bottom wall. The frame and drawer side walls include cooperating tongue and groove joints slidably guiding the drawer as it is withdrawn from and inserted into the frame.

The frame end walls comprise a head end wall and a foot end wall, one of which is formed by the header panel. The header panel includes an opening therein permitting the drawer to be moved therethrough.

The cap further preferrably includes a retainer mounted to and depending into the drawer. The retainer retains the drawer partially within the cap thereby preventing the drawer from being completely withdrawn from the cap.

The retainer is preferrably a spring steel clip mounted to the header panel. The clip includes a leg which depends downwardly into the drawer to contact a drawer end wall to prevent the drawer from being completely withdrawn from the cap. The clip is upwardly deflectable with a hand of a person to cause the depending leg to clear the drawer end wall to allow selective removal of the drawer from the cap.

The cap still further preferrably includes a magnetic latch and a drawer end wall includes a metallic object secured thereto. The magnetic latch and metallic object cooperate to retain the drawer within the cap in the storage position, and cooperate to release one from another upon a person's pressing inwardly on the drawer thereby releasing the drawer and permitting the drawer to be moved from the storage position to the display position. The magnetic latch is preferrably mounted to one of a pair of framed end walls, the one frame end wall including a notch therein for accepting the magnetic latch, and a metallic object is a metallic plate.

According to yet another aspect, a casket is provided having a memorabilia compartment comprising a shell including a pair of side walls and a pair of end walls, and a cap closable upon a shell. A cover member is supported by the shell, is positioned at a foot end of the shell and is adapted to cover the legs and lower torso of a deceased lying in the casket. A memorabilia drawer is movably mounted within the cover member and is movable to and between the display position in a storage position.

The memorabilia drawer is preferrably slidably mounted within the cover member. The casket is preferrably a full-couch casket having a single, full-length cap pivoted to the shell. The cover member is preferrably supported by the shell walls, as by being supported atop dowels pressed into holes in the shell walls. The cover member is preferrably elongated, generally rectangular and with a convex top.

The main advantage of the present invention is that a casket having a memorabilia compartment therein is provided which provides a designated receptacle or compartment for the placement of mementos therein which is an integral part of the casket and which does not present a haphazard, afterthought type of appearance.

Another advantage of the present invention is that a memorabilia compartment according to the principles of the present invention utilizes the wasted or otherwise unutilized space located above the legs of the deceased and/or within the casket cap to form the volume which is utilized as the receptacle or compartment.

Yet another advantage of the present invention is that a designated, easily accessible receptacle is provided which is integral to the casket and which will allow for family and friends of the deceased to include within the casket at the time of final closing or prior thereto mementos or other items of remembrance of the deceased.

Still another advantage of the present invention is that the invention will allow family members and friends of the deceased a more meaningful ceremony of memorialization and thereby greater consumer satisfaction with the purchase of the casket.

A further advantage of the present invention is that the invention will extend the functional utility of the casket to a new dimension, one that may significantly aid the cathartic process.

These and other objects and advantages of the present invention will become more readily apparent during the following detailed description taken in conjunction with the drawings herein, in which:

DETAILED DESCRIPTION OF THE INVENTION

Figure 1:
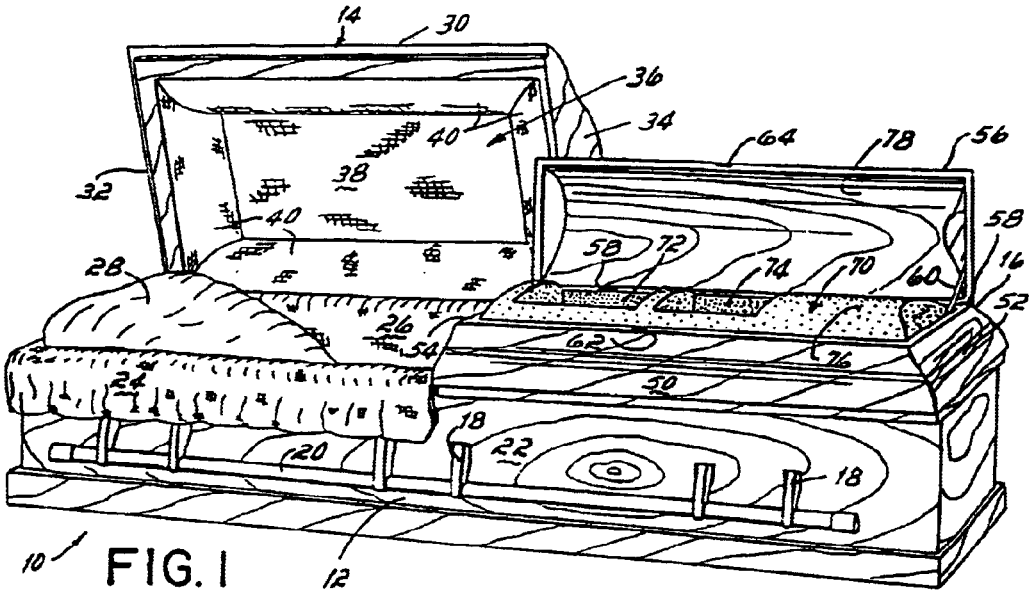
FIG. 1 is a perspective view of a casket including one embodiment of a cap memorabilia compartment.

Referring first to FIG. 1, there is illustrated a casket 10 constructed according to the principles of the present invention. While the casket 10 is illustrated as being fabricated from wood, it will be appreciated that the present invention may be included in either wood caskets or metal caskets. Referring now to the Figure, the casket 10 includes a casket shell 12 and a pair of half or split caps 14 and 16 pivoted to the shell 12 by hinges or other means known to those skilled in the art. Arms 18 attach a handle bar 20 to the casket shell side walls 22. The shell 12 includes conventional decorative interior components such as a big body 24, a small body 26, a pillow 28 and the like.

Cap 14 includes side rim members 30, 30, a head end rim member 32 secured to the head ends of the side rim members 30, 30 and a header panel 34 secured to the foot ends of the side rim members 30, 30. A decorative dish assembly 36 includes a cap panel 38 and peripheral puffing members 40 positioned around the perimeter of the cap panel 38 and is installed within the head end cap 14. The foot end cap 16 may include a similar decorative interior but it is not shown in FIG. 1. Foot end cap 16 similarly includes side rim members 50, 50, a foot end rim member 52 secured to the foot ends of the side rim members 50, 50 and a header panel 54 secured to the head ends of the side rim members 50, 50. A crown 56, which normally would be fixedly secured to the upper edges of the rim members 50, 50, 52 and the header panel 54, is instead pivoted to the rear side rim member 50 as by hinges 58. A crown brace 60 supports the crown 56 in the upward position, as shown in FIG. 1. Suitable latch structure 62 and 64 may be mounted in side rim member 50 and crown 56 to latch the crown 56 in the lowered, closed position.

Pivoting the crown 56 upward away from the balance of the cap 16 reveals a memorabilia tray 70 which is disposed within the rim members 50, 50, 52 and header panel 54. The memorabilia tray 70 is preferably fabricated of plastic, for example crematable high density polyethylene or HDPE, and may include a plurality of memorabilia containing compartments, for example two rectangular compartments 72 and 74. The tray itself may include a convex upper surface 76 for nesting within the concave inner surface 73 of the crown 56. Alternatively, surface 76 could be flush with the top edges of the side rim members 50, 50, end rim member 52 and header panel 54. The tray 70 is generally a press fit within the side rim members 50, 50, end rim member 52 and header panel 54. While latch structure 62, 64 is illustrated on the front, or viewing side of the casket, this latch structure could as well be placed centrally on the head end of the crown 56 or the foot end of the crown 56.

Figure 1A:
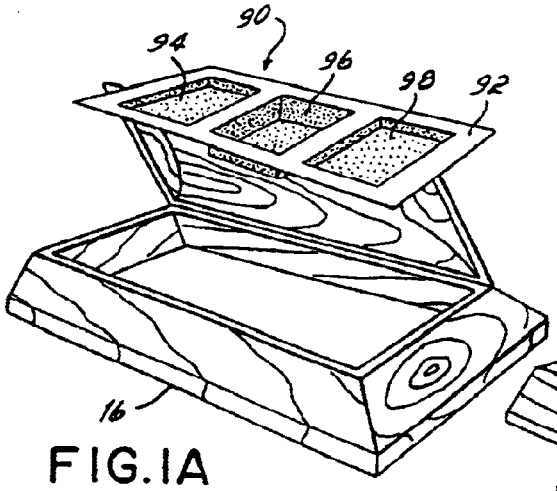
FIG. 1A is a perspective view of another tray for the memorabilia compartment of FIG. 1.

Referring now to FIG. 1A, there is illustrated another tray 90 which could be installed in the casket of FIG. 1. Tray 90 includes a generally flush top surface 92 and three memorabilia receptacles or compartments 94, 96 and 98. Head end compartment 94 and foot end compartment 98 are preferably about one inch deep and intermediate compartment 96 is preferably about four inches deep. The intermediate compartment 96 can be deeper than the foot end compartment 98, which is located generally directly above the feet of a deceased in the casket 10. When the body support structure of the casket 10 is raised to the highest position, the one inch deep compartment 98 still provides for the minimal required clearance above the deceased's feet. Intermediate compartment 96, however, is located just forward of a deceased's feet, and therefore it can be substantially deeper, for example about four inches deep as described above. Head end compartment 94 is preferably made of the same depth as foot end compartment 98 to make the tray 90 aesthetically symmetrical.

Figure 1B:
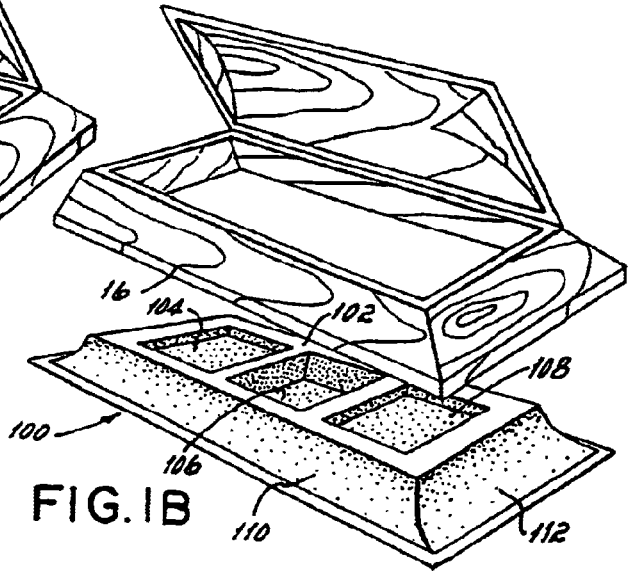
FIG. 1B is a perspective view of yet another tray for the memorabilia compartment of FIG. 1.

Referring now to FIG. 1B, another tray 100 is illustrated which can be included in the casket of FIG. 1. Tray 100 likewise similarly includes a generally flat top surface 102 with the three separate memorabilia receptacles 104, 106 and 108 similar to that illustrated in FIG. 1A. In addition, however, the tray 100 includes curved side walls 110, 110 and curved end walls 112, 112. Rather than being a press fit into the side rim members 50, 50, end rim member 52 and head wall 54, this tray would be installed from underneath the cap 16. The free edges of the walls 110 and 112 would then be secured to the rim members 50, 50 and 52 and head wall 54 by any suitable means, for example such as snapping into grooves or utilizing wood dowels or the like pressed into holes in the rim members 50, 50, 52 and head wall 54 atop which the free edges of the walls 110, 112 of the tray 100 would be supported after installation up into the cap 16. The underneath side of this form of tray 100 could be made to look substantially similar to the dish 36 in head end cap 14 including cap panel 38 and peripheral puffing members 40 so as to present the same general decorative look when the entire foot end cap 16 is pivoted upwardly.

Figure 2:
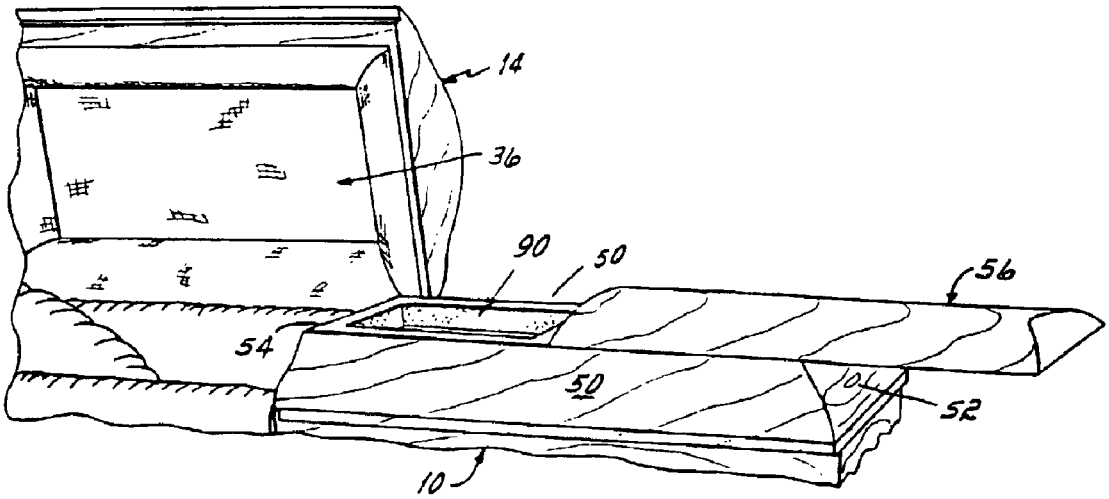
FIG. 2 is a partial perspective view of a casket including a second embodiment of a cap memorabilia compartment.

Referring now to FIG. 2, and with like numbers representing like elements, a second embodiment of the cap memorabilia compartment is illustrated. In this embodiment, the crown 56 is slidably mounted to the rim members 50, 50, 52 and head wall 54 as by tongue and groove joints or the like. In this embodiment, either of the alternative forms of the tray 90 and 100 illustrated in FIGS. 1A and 1B, respectively, would be employed which have flat top surfaces and which sit flush with the top edges of the rim members 50, 50, 52 and head wall 54.

Figure 3:
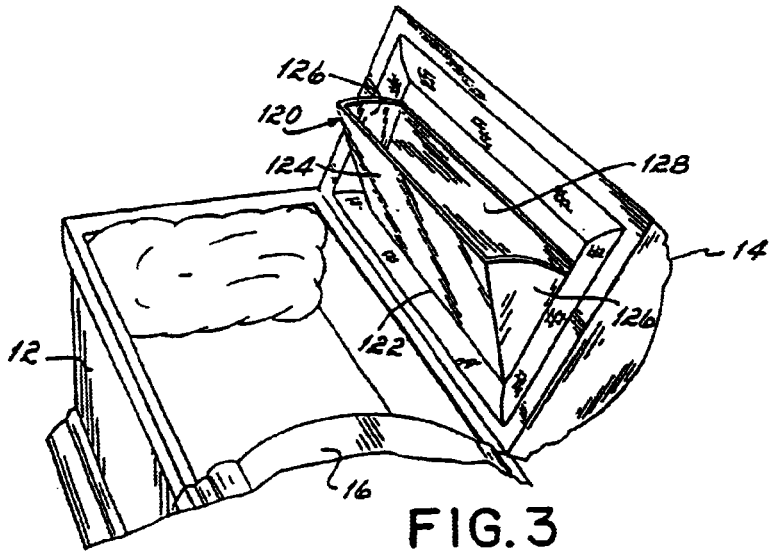
FIG. 3 is a partial perspective view of a casket including a third embodiment of a cap memorabilia compartment.

Referring now to FIG. 3, and with like numbers representing like elements, a third embodiment of the cap memorabilia compartment is illustrated. In this embodiment, the head end cap 14 is provided with a pivoting drawer 120. Drawer 120 is pivoted at its lower edge 122 to a portion of the cap 14, for example to cap panel 38, by hinges or other means known to those skilled in the art. The pivoting drawer 120 will preferably be generally triangular in cross section, having a front wall 124, a pair of triangular shaped opposed end walls 126 and back wall 128. Access is gained to the interior of the pivoting drawer 120 by first of course pivoting cap 14 upwardly relative to the shell 12 to its open position and then pivoting drawer 120 downwardly relative to crown 56 to its open position.

Figure 4:
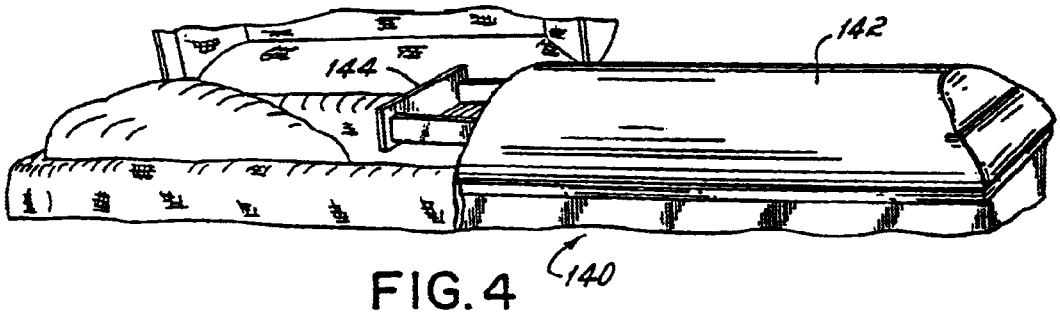
FIG. 4 is a partial perspective view of a casket including a fourth embodiment of a cap memorabilia compartment.
Figure 4A:
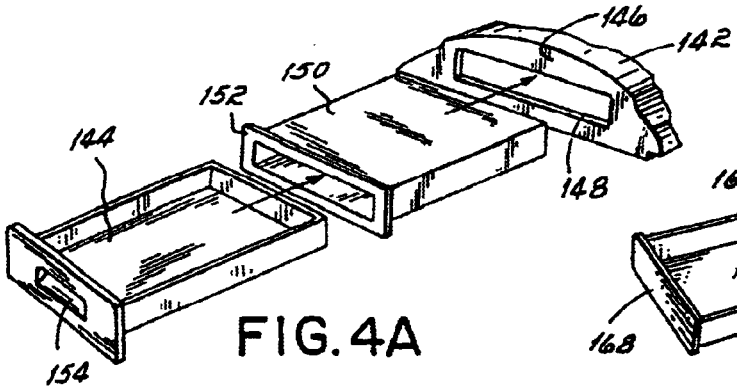
FIG. 4A is a partial perspective view of the memorabilia compartment of FIG. 3 for a metal casket.

Referring now to FIG. 4, there is illustrated a fourth embodiment of cap memorabilia compartment in a metal casket 140. In the foot end cap 142 of the casket 140 there is slidably disposed a drawer 144. FIG. 4A illustrates the construction of the cap 142 so as to accommodate the drawer 144. The header 146 includes opening 148 for accepting an inner compartment 150 having a flange 152 to be welded or epoxied in place against the header 146. Drawer 144 slides into and out of the interior of the compartment 150, and may be provided with a recess or groove 154 for grasping the drawer 144.

Figure 4B:
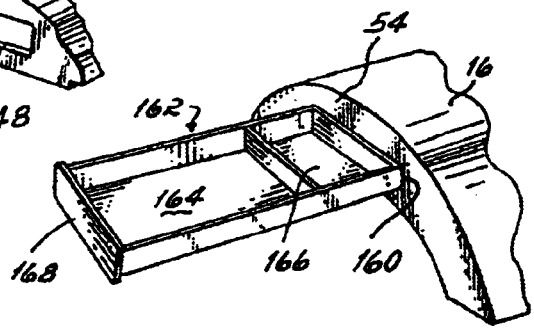
FIG. 4B is a partial perspective view of the memorabilia compartment of FIG. 3 for a wood casket.

FIG. 4B illustrates this same embodiment but in a wooden casket. Foot end cap 16 has a header wall 54 with an opening 160 therein for accepting a drawer 162 which may have one or several, and as illustrated, has two generally equally sized memorabilia compartments or receptacles 164 and 166. A recess may be provided in the header 54 along the lower edge of opening 160 to allow one's fingers to grasp beneath the lower edge of drawer front 168 to pull the drawer 162 out. Suitable supporting structure such as a panel or the like underlies the drawer 162 to support it when pushed in.

Figure 5:
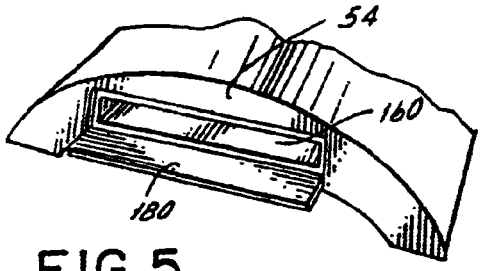
FIG. 5 is a partial perspective view of a fifth embodiment of a cap memorabilia compartment.

Referring now to FIG. 5, there is illustrated a fifth embodiment of cap memorabilia compartment. This embodiment is substantially the same as the FIG. 4 embodiment, especially the FIG. 4B embodiment, except that rather than the drawer front 168 forming a part of the header wall 54 when the drawer 162 is inserted or slid into the cap 6, all or a portion of the header wall 54 is hinged for example portion 130 hinged at its lower edge to header wall 54 by hinges or other conventional means known to those skilled in the art, to provide access to a hidden drawer. Thus, the header wall 54 is pivoted downwardly, or a portion of the header wall for example that shown at 130 is pivoted downwardly, to provide access to a drawer disposed in opening 160 and normally concealed by header wall 54.

Figure 6:
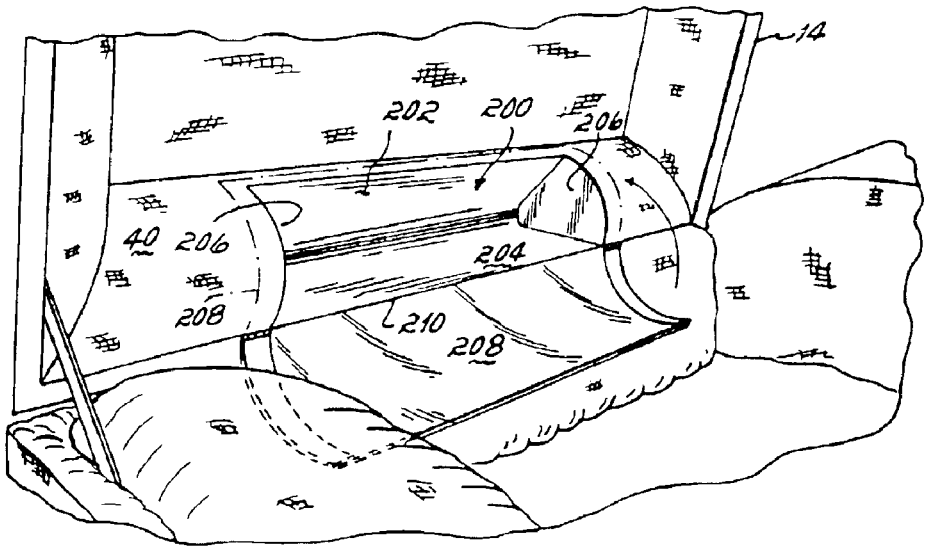
FIG. 6 is a partial perspective view of a sixth embodiment of a cap memorabilia compartment.

Referring now to FIG. 6, a sixth embodiment of cap memorabilia compartment is illustrated. In this embodiment, a capsule 200 is disposed in the puffing member 40. The capsule 200 has a generally quarter-circular cross section to match the generally quarter-circular cross section of the puffing member 40. The capsule 200 would include a rear wall 202, a bottom wall 204 and opposed end walls 206. A transparent cover 208 is hinged alone its lower edge 210 to the bottom wall 204 of the capsule 200 by hinges or other means known to those skilled in the art. Pivoting transparent cover 208 allows for access to the interior of the compartment 200 as well as continuous viewing of the memorabilia placed therein.

Figure 7:
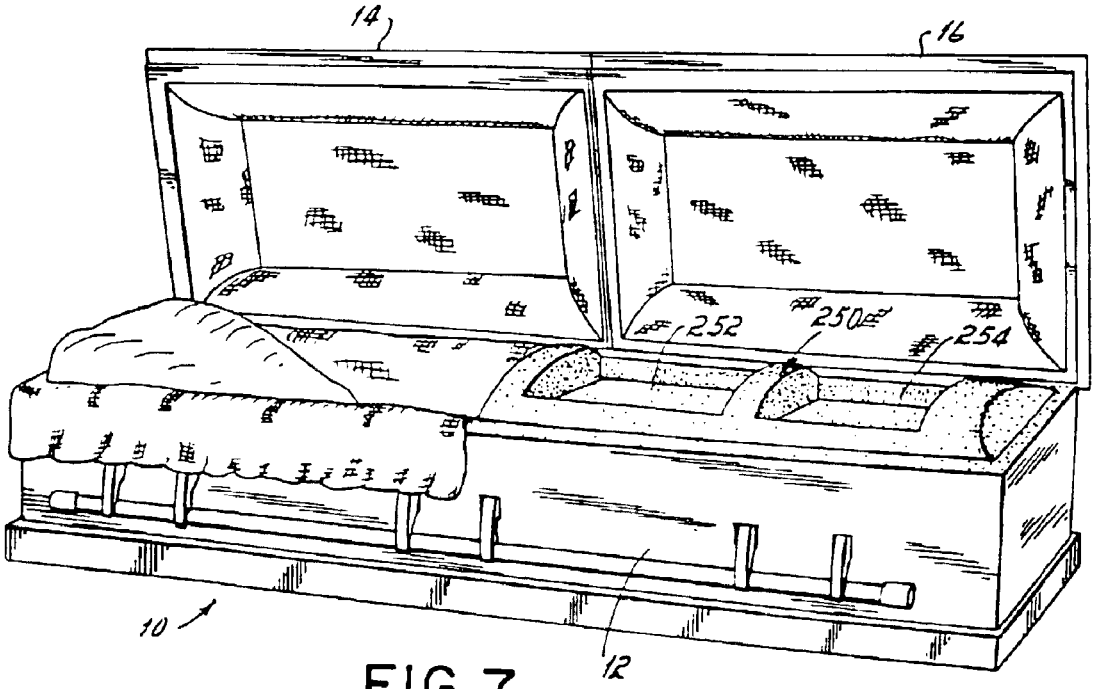
FIG. 7 is a perspective view of a casket including one embodiment or a shell memorabilia compartment.

Referring now to FIG. 7, there is illustrated one embodiment of a shell memorabilia compartment. In this form of the invention, a memorabilia tray 250, having compartments 252 and 254 similar to the tray 70 of FIG. 1, is positioned directly in the shell 12 as opposed to being installed in the foot end cap 16. The tray 250 may be supported atop wooden dowels (not shown) pressed into holes (not shown) in the casket shell side and end walls. Alternatively, tray 250 could include the compartment configuration illustrated in FIGS. 1A and 1B.

Figure 8:
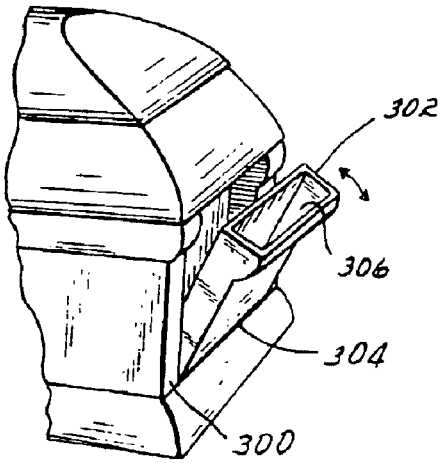
FIG. 8 is a partial perspective view of a casket including a second embodiment of a shell memorabilia compartment.

Referring now to FIG. 8, and with like numbers representing like elements, a second embodiment of a shell memorabilia compartment is illustrated. In this embodiment, shell end wall 300 is provided with a pivoting drawer 302 pivoted at its lower edge 304 by hinges or other means known to those skilled in the art to end wall 300. Pivoting of drawer 302 away from the end wall 300 provides access to the interior 306 of drawer 302.

Figure 9:
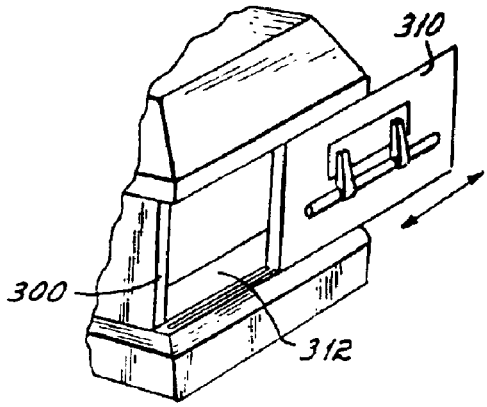
FIG. 9 is a partial perspective view of a casket including a third embodiment of a shell memorabilia compartment.

Referring now to FIG. 9, and with like numbers representing like elements, there is illustrated a third embodiment of shell memorabilia compartment. In this embodiment, shell end wall 300 is provided with a sliding panel portion 310 slidable relative to the balance of the end wall 300 to provide access to an interior 312 normally concealed by the sliding panel portion 310.

Figure 10A:
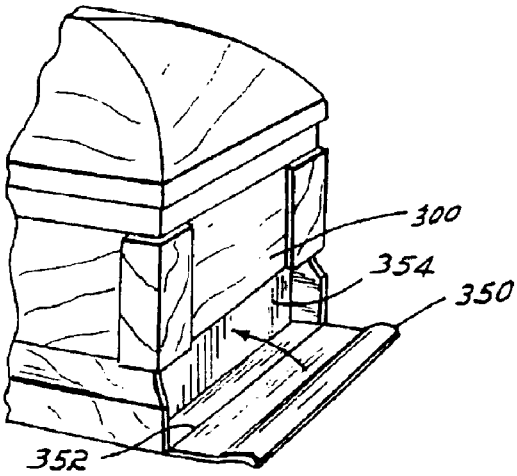
FIG. 10A is a partial perspective view of a casket including one form of a fourth embodiment of a shell memorabilia compartment.

Referring now to FIGS. 10A–E, six forms of a fourth embodiment of a shell memorabilia compartment are illustrated. In this fourth embodiment, decorative casket trim is movably mounted to a portion of the casket shell walls and normally conceals a compartment therebehind. The decorative trim is movable from a first position in which the compartment is concealed to a second position in which the compartment is exposed. The trim may be pivotally mounted, slidably mounted or removably mounted to the casket shell walls. In one form as shown in FIG. 10A, base mold 350 is pivoted at its lower edge 352 by hinged or other means known to those skilled in the art to end wall 300. Pivoting the base mold 350 away from the end wall 300 exposes the interior 354 of the compartment. In a second form shown in FIG. 10B, an ear or escutcheon plate 360 is pivoted at its lower edge 362 by hinges or other means known to those skilled in the art to one of the casket walls. Pivoting the ear 360 away from the casket wall exposes the interior 364 of the compartment.

Figure 10B:
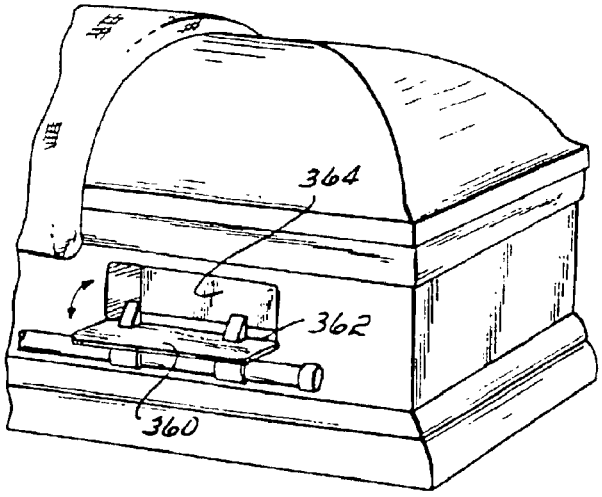
FIG. 10B is a partial perspective view of a casket including a second form of the fourth embodiment of the shell memorabilia compartment.
Figure 10C:
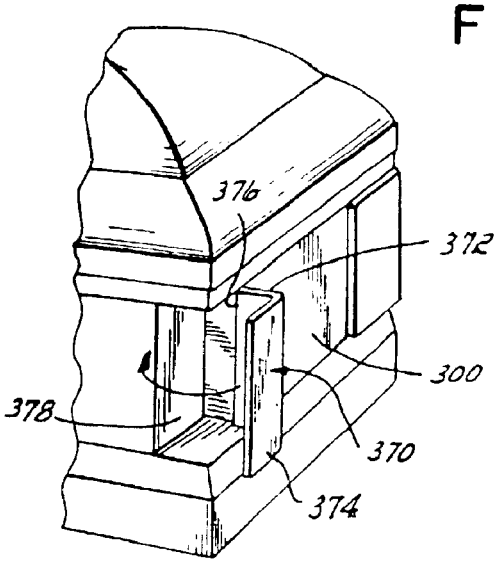
FIG. 10C is a partial perspective view of a casket including a third form of the fourth embodiment of the shell memorabilia compartment.
Figure 10D:
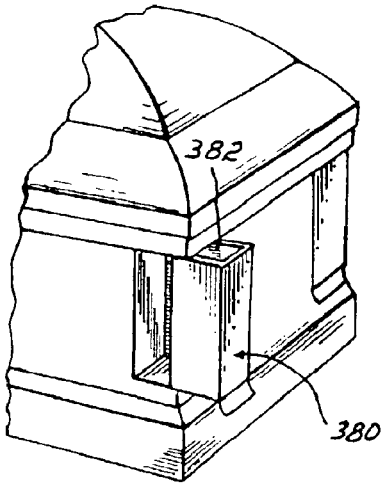
FIG. 10D is a partial perspective view of a casket including a fifth form of the fourth embodiment of the shell memorabilia compartment.
Figure 10E:
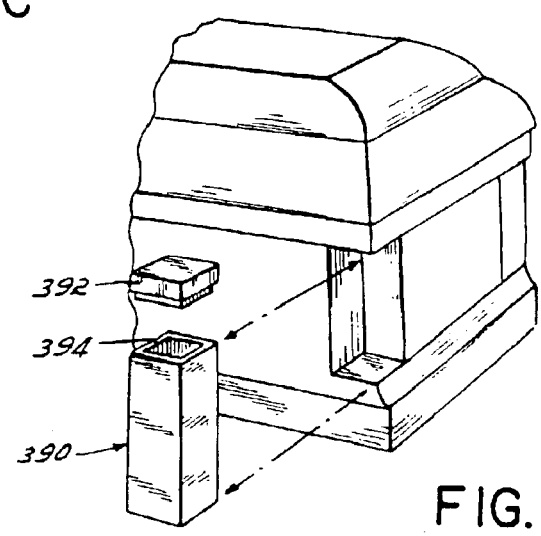
FIG. 10E is a partial perspective view of a casket including a sixth form of the fourth embodiment of the shell memorabilia compartment.

Referring now to FIGS. 10C–E, three other forms of the invention utilizing movably mounted decorative trim to form the shell memorabilia compartment are illustrated. In FIG. 10C, a corner post 370 including walls 372 and 374 is pivoted to the shell end wall 300 by hinges or other means known to those skilled in the art at edge 376 of wall 372. Pivoting the corner post 370 away from the end wall 300 provides access to the interior 378 of the compartment. FIG. 10D is similar, except that corner post 380 is a rectangular receptacle having an open top 382, access to which is provided by sliding the receptacle 380 longitudinally or transversely relative to the casket shell. In FIG. 10E, corner post 390 is similar to that shown in FIG. 10D, except that the post 390 is completely removable from the casket shell and includes a cap 392 for closing the open upper end 394 of the post 390.

Figure 11:
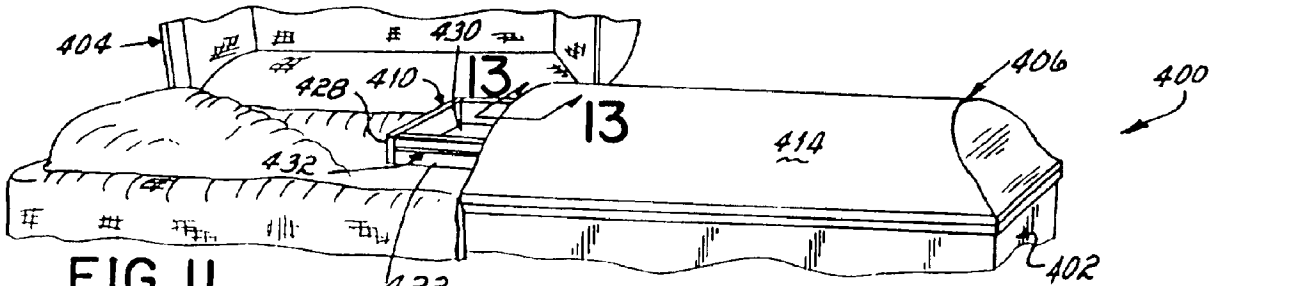
FIG. 11 is a view similar to FIG. 4 of a preferred embodiment of the cap memorabilia compartment of FIG. 4.
Figure 12:
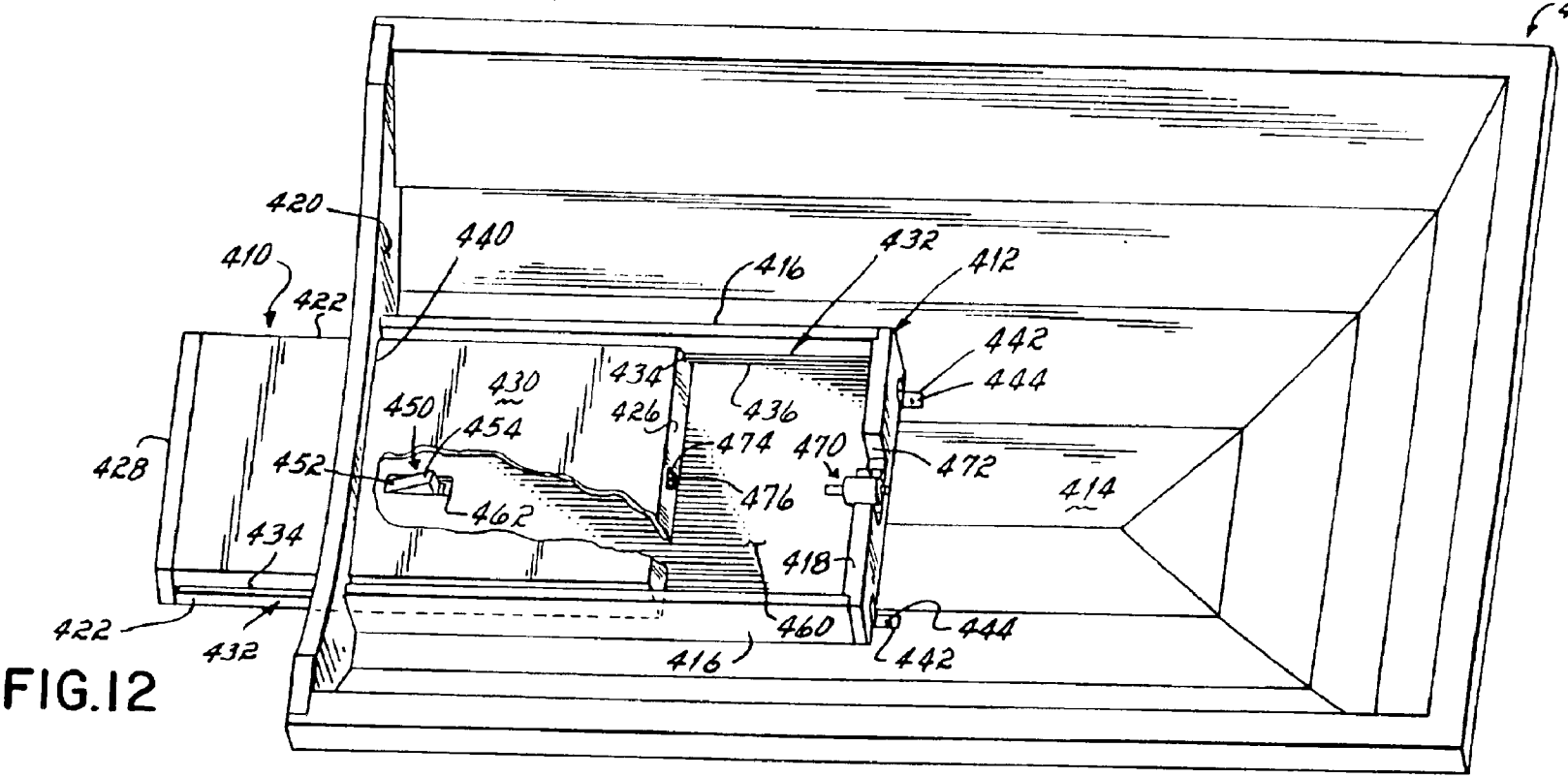
FIG. 12 is a bottom view looking into the foot cap of FIG. 11.
Figure 13:
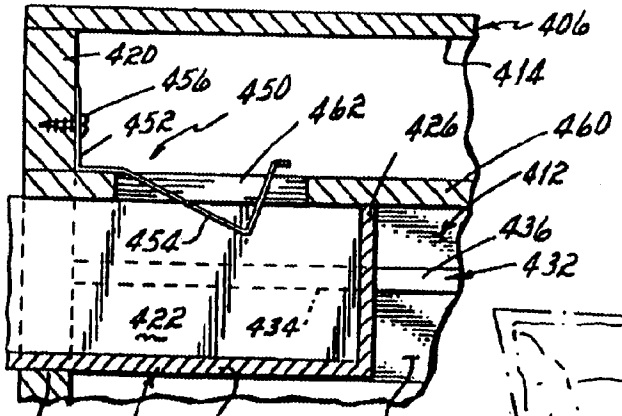
FIG. 13 is a view taken alaong line 13–13 of FIG. 11.

Referring now to FIGS. 11–13, there is illustrated a preferred construction of a wooden casket with memorabilia drawer slidably mounted within a cap of the casket. More particularly, in FIG. 11 there is illustrated a casket 400 including a shell 402 and head end 404 and foot end 406 caps or lids pivoted to the shell 402 with hinges or the like known to those skilled in the art and closable upon the shell 402. Foot and cap 406 includes a memorabilia drawer 410 slidably mounted to the cap 406 and slidable to and between a display position and a storage position.

As shown in FIG. 12, when viewing the cap 406 from underneath, it will be seen that drawer 410 is slidably mounted within a frame 412 mounted to the underside of the crown 414 of the cap 406. Frame 412 is generally rectangular and comprises a pair of side walls 416, 416 and a pair of end walls 418, 420. Drawer 410 comprises a pair of side walls 422, 422, a pair of end walls 426, 428 and a bottom wall 430. The frame side walls 416, 416 and drawer side walls 422, 422 include cooperating tongue-in-groove joints 432 for slidably gliding the drawer 410 as it is withdrawn from and inserted into the frame 412. Preferably the drawer sidewalls 422, 422 include the groove 434 portion of the tongue-in-groove joint and the frame side walls 416, 416 include the tongue 436 portion of the tongue-in-groove joint.

As is seen in FIG. 12, frame end wall 420 is formed by the header, which includes an opening 440 therein permitting the drawer 410 to be moved there through.

Frame end wall 418 is secured to the crown 14 via brackets 442 and screws 444. Sidewalls 416, 416 are secured to end wall 418 via any suitable fasteners, for example, staples, glue, screws, tongue-in-groove joints, dowels, or any suitable combination thereof. The drawer side 422, 422, end 426, 428 and bottom 430 walls are secured together with the same or similar fastening means. Sidewalls 416, 416 are secured to header 420 also via the same or similar fastening means. Further, the upwardly facing surface of bottom 430 may be flocked or lined with velvet or other attractive material. Drawer side 422, 422 and end 426 walls may be fabricated of suitable wood, for example maple; bottom wall 430 is preferably hardboard; and end wall 428 is preferably wood of the same type as, or is otherwise finished to match, the wood of the balance of the casket 400. Frame sidewalls 416, 416 and end 418 may be fabricated of any suitable wood, for example maple, and end wall 420, or header, is preferably wood of the same type as, or is otherwise finished to match, the wood of the balance of the casket 400.

Referring now to FIGS. 12 and 13, it will be seen that the cap 406 includes a retainer 450 mounted thereto which depends into the drawer 410 to retain the drawer 410 partially within the cap 406, thus preventing the drawer 410 from being completely withdrawn from the cap 406. More particularly, retainer 450 is a spring steel clip 452 which includes a leg 454 which depends downwardly into the drawer 410 and which is operable to contact drawer end wall 426 to prevent the drawer 410 from being completely withdrawn from the cap. Clip 452 is secured to header panel 420 via a screw 456. Clip 450 is preferably fabricated of spring steel, is plated to prevent oxidation, and is available from Hoffco of Woodlake, Minn. as part no. 727. Leg 454 of clip 452 is upwardly deflectable by the hand of a person reaching into the open drawer 410 to allow the end wall 426 to clear the leg 454 to allow selective removal of the drawer 410 from the cap 406 as desired. Frame 412 includes a top wall 460 secured to the side 416, 416 and end 413 walls of the frame 412 via staples or the like, fabricated of hardboard, and including a slot 462 formed therein which allows leg 454 of clip 452 to depend downwardly into the drawer 410.

Cap 406 further includes a magnetic latch 470 which is mounted to frame end wall 418 within a notch 472. Magnetic latch 470 cooperates with a metallic plate 474 secured via a screw 476 to drawer end wall 426. Magnetic latch 470 may be of a type available from Hoffco of Woodlake, Minn. as part no. 453-C. Magnetic latch 470 and plate 474 cooperate to retain the drawer 410 within the cap 406 in a storage position, and cooperate to release one from another upon a person's pressing inwardly on the drawer 410 which releases the magnetic latch 470 from the plate 474 and causes the drawer 410 to be ejected slightly out of the frame 412 whereby it is easily grasped and pulled to the open position.

Figure 14:
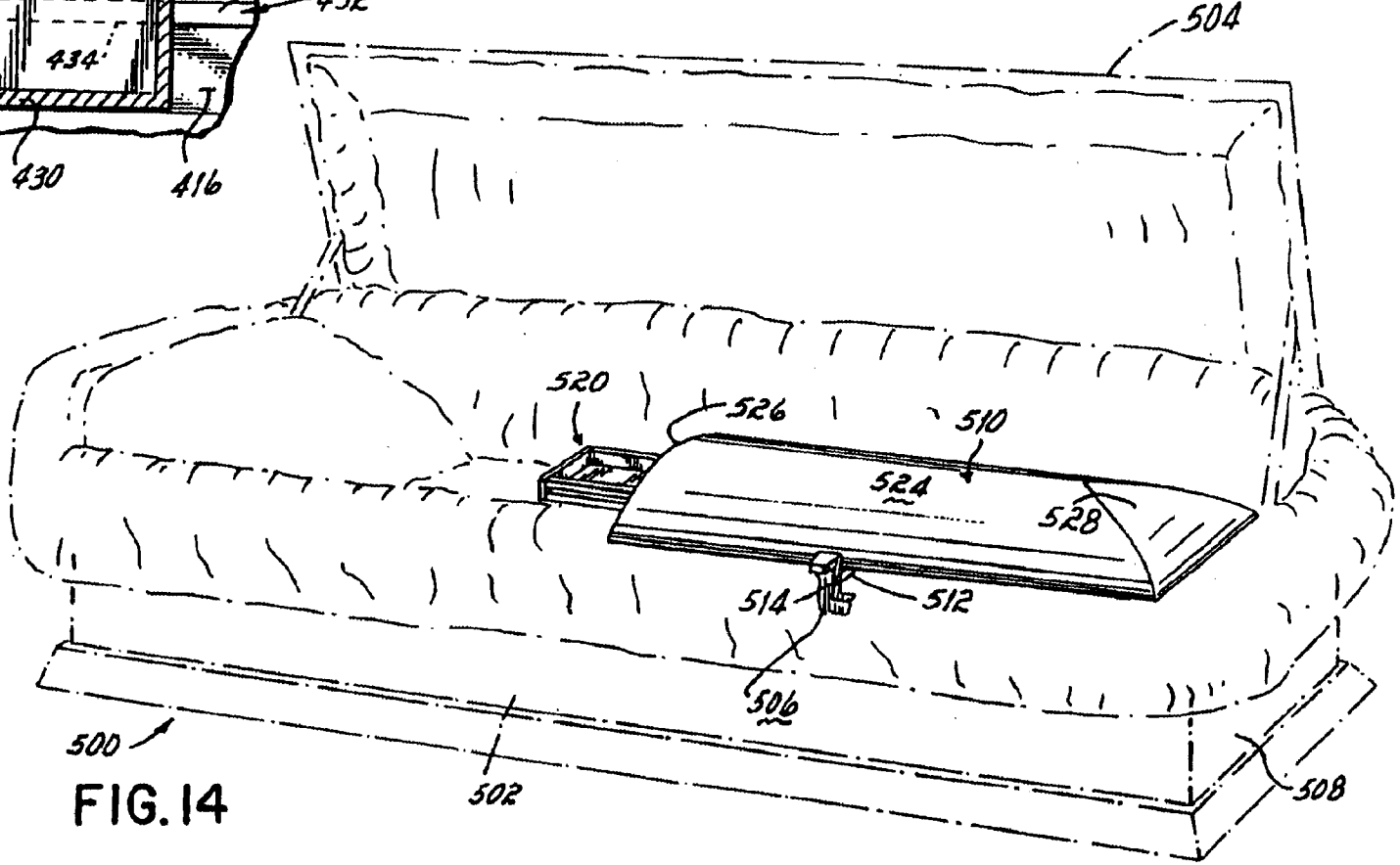
FIG. 14 is a perspective view of yet another emobidment of memorabilia compartment.

Referring to FIG. 14, there is illustrated yet another form of the invention. In FIG. 14 there is shown the casket 500 comprising a shell 502 to which is pivoted via hinges or the like known to those skilled in the art a cap or lid 504 closeable thereon. Casket 500 is a so-called full-couch casket wherein the cap or lid 504 is a single, full-length cap pivoted to the shell 502. The shell 502 includes a pair of side walls 506 and a pair of end walls 508. A cover member 510 is supported by the shell 502, for example, is supported upon wooden dowels 512 pressed into holes 514 in the shell wall 516, is positioned at the foot end of the shell 502 and is adapted to cover the legs and torso of a deceased lying in the casket 500. There is a memorabilia drawer 520 movably mounted within the cover member 510 and movable to and between a display position and a storage position. Drawer 520 could be supported within the frame structure 112 described above, including all the features thereof such as magnetic latch 470 and retainer clip 450, or it could be simply supported by, for example, a panel or the like underlying the drawer 520. Cover member 510 is elongated, rectangular and includes a convex top or crown 524. Cover member 510 may also include a header panel 526 similar to that discussed above in connection with the casket caps. Cover member 510 may further include a pie-shaped section 528 at a footend thereof. Cover member 510 is sometimes referred to as an "inner panel" in the trade. Cover member 510 is also sometimes referred to as a "cap" in the trade, since the structure of the cover member 510 is generally the same as that of a casket cap pivoted to its shell, less the peripheral rim portion of the cap.

While the present invention has been described in conjunction with wood and metal caskets, it will be readily appreciated that the invention could also be incorporated in caskets of other constructions, for example, composites, plastics, paperboard, cardboard, hardboard, papier-mâché or the like. The invention therefore is not to be limited to simply wood and metal caskets.

Further, while the drawer type memorabilia compartments illustrated herein may be shown to be pullable from one particular end of a casket cap, lid, cover member and/or inner panel, it will be appreciated that the drawer may be mounted so as to be withdrawable from the other end of the cap, lid, cover member and/or inner panel, and that both are within the scope of the present invention.

Still further, the drawer type memorabilia compartment could be employed with the single, full-length cap or lid of a full-couch casket, and withdrawable from either the head end or foot end thereof, and that the same is also within the scope of the present invention.

Those skilled in the art will readily recognize numerous adaptations and modifications which can be made to the present invention which will yield an improved casket having memorabilia compartment, yet all of which will fall within the spirit and scope of the present invention as defined in the following claims. Accordingly, the invention is to be limited only by the scope of the following claims and their equivalents.

What is claimed is:

1. A casket adapted to receive a deceased comprising:

a shell having a bottom, a pair of opposed sides, and a pair of opposed end;

a lid; said shell and said lid cooperating to define a pair of opposed casket ends wherein each said casket end is formed by at least a part of said shell and at least a part of said lid, said casket having a space therein to receive contents of the deceased, at least a part of one of said pair of casket ends being a drawer receivable within the space to convey the contents into the space.

2. The casket of claim 1 wherein said drawer is slideably receivable within the space.

3. The casket of claim 1 wherein said drawer is pivotably receivable within the space.

4. The casket of claim 1 wherein said drawer is formed as a part of said shell.

5. The casket of claim 1 wherein said drawer is formed as a part of said lid.

6. The casket of claim 1 wherein the contents comprise memorabilia.

7. A method of utilizing a casket in a funeral service comprising:

providing a shell having a bottom, a pair of opposed sides and a pair of opposed ends, providing a lid, said shell and said lid cooperating to define a pair of opposed casket ends wherein each said casket end is formed by at least a part of said shell and at least a part of said lid.

providing in at least a part of one of the casket ends a relatively moveable drawer, placing contents of a deceased in the drawer in a position retracted from the casket, conveying the contents into the casket by relatively moving the drawer into the casket, and displaying the casket containing the contents in the funeral service.

8. The method of claim 7 wherein the drawer is slideably moveable.

9. The method of claim 7 wherein the drawer is pivotably moveable.

10. The method of claim 7 wherein the drawer is formed as a part of the shell.

11. The method of claim 7 wherein the drawer is formed as a part of the lid.

12. The method of claim 7 wherein the contents comprise memorabilia.

* * * * *

UNITED STATES PATENT AND TRADEMARK OFFICE

CERTIFICATE OF CORRECTION

PATENT NO. : 6,976,294 B2
DATED : December 20, 2005
INVENTOR(S) : John P. Biondo et al.

It is certified that error appears in the above-identified patent and that said Letters Patent is hereby corrected as shown below:

Column 7,
Line 42, should read -- the cap 16, all or a portion of the header wall 54 is hinged for --.
Line 43, should read -- example portion 180 hinged at its lower edge to header wall --.
Line 47, should read -- header wall for example that shown at 180 is pivoted --.
Line 57, should read -- transparent cover 208 is hinged along its lower edge 210 to --.

Column 9,
Line 54, should read -- wall 460 secured to the side 416, 416, and end 418 walls of --.

Column 10,
Line 18, should read -- 520 could be supported within the frame structure 412 --.
Line 64, should read -- a pair of opposed ends --.

Column 11,
Line 22, should read -- at least a part of said shell and at least a part of said lid, --.

Signed and Sealed this

Thirtieth Day of May, 2006

JON W. DUDAS
*Director of the United States Patent and Trademark Office*